United States Patent [19]

Wang et al.

[11] Patent Number: 4,744,124

[45] Date of Patent: May 17, 1988

[54] MUSIC TOOTH BRUSH

[75] Inventors: Kuo-Hsien Wang; Feng-Lin Huang; Wuein-Hwa Ho, all of Keelung, Taiwan

[73] Assignee: Tech Zeal Industrial Company, Ltd., Taiwan

[21] Appl. No.: 6,762

[22] Filed: Jan. 27, 1987

[51] Int. Cl.[4] ..... A46B 9/04

[52] U.S. Cl. ..... 15/105; 15/167.1; 84/94.2

[58] Field of Search ..... 15/167 R, 105; 128/360; 84/94.2

[56] References Cited

U.S. PATENT DOCUMENTS 4,554,919 11/1985 Hubert ..... 128/360

FOREIGN PATENT DOCUMENTS 28578 10/1980 European Pat. Off. ..... 15/105

2471757 6/1981 France ..... 15/105

*Primary Examiner*—Peter Feldman

*Attorney, Agent, or Firm*—Ostrolenk, Faber, Gerb & Soffen

[57] ABSTRACT

A music tooth brush comprises a hollow brush hair stock, a touch switch containing the hollow part of said brush hair stock, a brush hair board floatingly mounted on the brush hair stock, and a hollow grip handle bar containing the music IC, batteries and sound-generating plate. When the user brushes his teeth with the said tooth brush, the brush hair board can touch and press the touch switch in the brush hair stock to make the circuit in the grip handle bar become electrically conductive, so the sound-generating plate automatically generates the children's favorite music to eliminate their sense of ill feeling against brushing their teeth and further to foster in children a good habit of brushing their teeth after eating.

2 Claims, 1 Drawing Sheet

A - A SECTION

B - B SECTION

B-B SECTION

A-A SECTION

MUSIC TOOTH BRUSH

FIELD OF THE INVENTION

The present invention relates to a music tooth brush, and particularly it offers children a brush that can automatically generate recorded music or recorded talk to foster in children the habit of brushing their teeth with no need of adult urging.

BACKGROUND OF THE INVENTION

According to medical literature, man's healthy teeth greatly affects his overall health. Therefore, constant health preservation treatment of teeth is an integral part of maintaining physical health, and also is closely related to facial appearance. Currently, the most important work for preservation of healthy teeth is to brush teeth after eating in order to remove the residual food bits left in the gaps between teeth, so as to avoid their fermentation which damages the teeth roots. Especially, children love to eat sweet foods and candies. Their teeth will be which damaged if they don't brush their teeth on time. Hence parents often supervise and urge their children to brush their teeth. Various kinds of candy flavor tooth pastes have been marketed to eliminate the children's dislikes of the common tooth pastes, but the effects are very undesirable, so it is still quite hard to make foster in children a habit brushing their teeth after eating, and therefore, damage rate of the children's teeth in general still remains very high.

OBJECTS OF THE INVENTION

The main object of the present invention is to solve above-said difficulties and to provide a music tooth brush, which will automatically generate the music or talk during use so as to attract children's curiousity and interest which in turn fosters a good habit of brushing their teeth constantly.

SUMMARY OF THE INVENTION

A music tooth brush mainly comprises a hollow brush hair stock, a touch switch, a brush hair board, a hollow grip handle bar, a music IC, a battery, and a sound-generating plate. Its features lie in that when the user brushes his teeth with this invention, the brush hair board can touch and press the touch switch in the brush brush hair stock to automatically make the circuit in said handle bar become electrically conductive, so the sound-generating plate generates the music. When the brush hair moves away from the teeth, the brush board restores to its original position and said touch switch restores to the "off" position, so the circuit is open, and the sound-generating plate will automatically stop its sound-generating function. Evidently this invention can induce children to foster the good habit of brushing their teeth, thereby achieving maintenance of their teeth and further their physical body health.

SPECIFIC DESCRIPTION OF THE INVENTION

Figure 1:
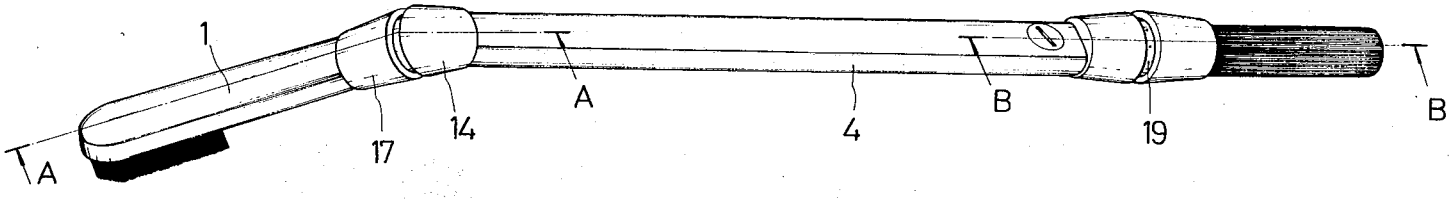
FIG. 1 is an outside tridimensional view of the structure of the present invention.
Figure 3:
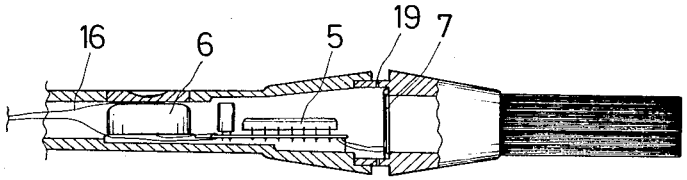
FIG. 3 is a partial cross sectional view along B—B in FIG. 1.
Figure 2:
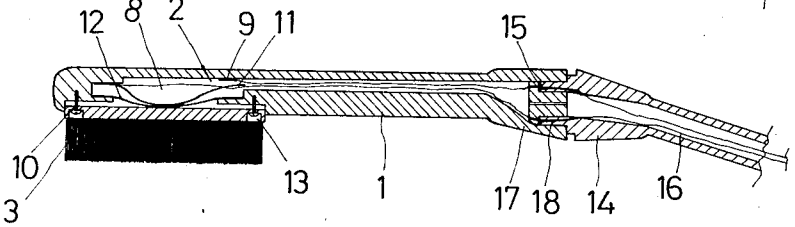
FIG. 2 is a partial cross sectional view along A—A in FIG. 1.

Referring to the drawings, the tooth brush of this invention is composed of a hollow brush hair stock 1, a touch switch 2, a brush hair board 3, a hollow handle bar 4, a music IC 5, a battery 6 and a sound-generating plate 7. The hollow brush hair stock 1 (as shown in FIGS. 1, 2) is integrally formed of a plastic. The hollow portion 8 of its front part contains and joins a touch switch 2. The touch plate 9 on said switch 2 is made of a phosphor bronze plate with a proper elasticity. The bent arcuate back of said plate 9 is directly pressed by the protrusion from the opening of the hollow portion 8 to a position outside of said opening. The brush hair board 3 positioned by positioning pins 10 poise said brush hair board 3 at the highest position. Three pins 10 may be used, but additional pins may be used as needed. When the tooth brush is in use, the brush hair on said brush hair board 3 contacts the user's teeth, and pushes said brush hair board 3 to the lowest position to press the upper touch plate 9 of said touch switch 2 to the position flush with the opening of said hollow portion 8. The touch points portion on said upper touch plate 9 engages the lower touch plate 11, thereby making the circuit in the grip handle bar 4 become electrically conductive, so that the sound-generating plate 7 generates the music. The opening of said hollow portion 8 of said brush hair stock 1 is joined with a soft water-proof diaphragm 12 to avoid the entry of water, but not to hamper the actuation of the upper contact plate 9. Brush hair is planted on the brush hair board 3. Three or more through eye holes 13 are provided and three positioning pins 10 pass through and also are positioned in the opening of hollow portion 8 in the front part of said brush hair stock 1 and are also supported by the back of said upper touch plate 9. The front end of said grip handle bar 4 is provided with a plug 14. On the front rim of said plug are provided two power supply contact points 15 connected with wires 16, one of said wires 16 that passes through the hollow portion is connected to the positive pole of said battery 6, while the other wire 16 is connected to the music IC. When said plug 14 is plugged into the socket 17 on the rear end of said hair brush 11 said two power supply contact points 15 contact the two contact points 18 on the bottom of the plug 17 to conduct the supply power required by the circuit through the action of said touch switch 2. At a proper position on the hollow portion of said grip handle bar 4 is fixed a small mercury battery 6, a music IC 5 and said sound-generating plate 7. Several sound-transmitting holes 19 are provided in the wall of the bar close to said sound-generating plate 7 to transmit the music therefrom.

In operation, the user only needs to place the tooth paste on said brush hair, and when the brush hair contacts and is pressed by teeth, the touch switch 2 is touched and pressed to the "on" position to make the circuit in the grip handle bar 4 electrically conductive, so the sound-generating plate 7 generates pleasant music. When the user stops brushing his teeth, the pressure against the brush hair board 3 diminishes and so said touch switch 2 restores to the "off" position and therefore, the music play is stopped.

In the invention, the shapes of said brush hair stock 1 and grip handle bar 4 may have any appropriate form. The brush hair stock 1 and grip handle bar 4 may be combined and made integral with the tooth brush stock.

The shape shown in FIG. 1 is only an examplary type of the present invention.

We claim:

1. A music tooth brush comprising:

a brush hair stock having a hollow portion therein, a grip handle bar attached to the brush hair stock for holding the stock;

a touch switch in the hollow portion; the touch switch including an upper touch plate and a stationary contact surface normally spaced from the upper touch plate; the upper touch plate and the stationary contact surface being movable together into contact; the upper touch plate having a bent, arcuate, elastic back;

a music IC connected with the contacting upper touch plate for being actuated by the contacting of the upper touch plate with the stationary contact surface; a sound generating plate connected with the music IC for being operated as the music IC is actuated; and a battery connected with the music IC and the sound generating plate for powering them;

the hollow portion having an opening; a protrusion extending from the opening of said hollow portion exteriorly of the opening; the arcuate, elastic back being directly pressed by the protrusion from the opening; and a brush hair board having a top side carrying hair and having a bottom; means for positioning the bottom of the brush hair board for enabling the hair board to be moved, by pressure applied to the hairs, for the hair board to move the upper touch plate and the contact surface into contact, and the arcuate back normally pushing the contact surface and upper touch plate apart, wherein the positioning means comprises a plurality of positioning pins and a corresponding plurality of positioning openings inside the brush hair board, the positioning pins locating the brush hair board at an initial position furthest removed from the stationary contact surface, and wherein a contact is provided on the upper touch plate and is arranged so that when pressure is applied to the hairs, the contact on the upper touch plate engages the lower stationary contact surface, thereby closing a circuit including the IC, the battery, and the sound-generating plate to generate sound.

2. The music tooth brush of claim 1, wherein the touch switch is protected by further comprising a diaphram of water-impermeable material stretched in the hollow portion between the touch switch and the opening to the hollow portion.

* * * * *